US005782247A

United States Patent [19]

Sadley et al.

[11] Patent Number: 5,782,247

[45] Date of Patent: Jul. 21, 1998

[54] SYSTEM AND METHOD FOR BUFFING AND POLISHING FINGERNAILS AND TOENAILS

[76] Inventors: Susan J. Sadley; William C. Sadley, both of 35387 Hathaway St., Livonia, Mich. 48150

[21] Appl. No.: 901,984

[22] Filed: Jul. 29, 1997

[51] Int. Cl.[6] ..... A45D 29/18

[52] U.S. Cl. ..... 132/76.4; 132/200; 51/392

[58] Field of Search ..... 132/76.2, 76.4, 132/76.5, 73.5, 73, 75.4, 75.3, 286, 200; 451/523, 525, 538, 552, 557; 206/455, 39; 51/391, 392, 393; 383/40

[56] References Cited

U.S. PATENT DOCUMENTS

| | | | |
|---|---|---|---|
| 2,450,207 | 9/1948 | Silverman . | |
| 2,551,700 | 5/1951 | Pinco | 132/73.5 |
| 2,953,141 | 9/1960 | Bader, Jr. | 132/73.5 |
| 3,706,316 | 12/1972 | Ishii . | |
| 3,866,618 | 2/1975 | Tsukamoto . | |
| 4,381,792 | 5/1983 | Busch, Jr. et al. . | |
| 4,712,552 | 12/1987 | Pangburn | 132/76.4 |
| 4,716,948 | 1/1988 | Brissette | 206/39 |
| 5,088,509 | 2/1992 | Savage, III . | |
| 5,176,155 | 1/1993 | Rudolph, Jr. | 132/76.4 |
| 5,287,863 | 2/1994 | La Joie et al. | 132/76.4 |
| 5,358,115 | 10/1994 | Pietsch et al. | 206/455 |
| 5,374,975 | 12/1994 | Amat | 206/455 |
| 5,666,981 | 9/1997 | Stephens | 132/76.4 |

FOREIGN PATENT DOCUMENTS

| | | |
|---|---|---|
| 79928 | 2/1950 | Czechoslovakia . |
| 26362 | of 1913 | United Kingdom . |

*Primary Examiner*—Gene Mancene
*Assistant Examiner*—Pedro Philogene
*Attorney, Agent, or Firm*—Brooks & Kushman P.C.

[57] ABSTRACT

An improved system and method for buffing and polishing fingernails and toenails. The improved nail care system includes at least two fabric strips. Each fabric strip has two surfaces with at least one of the two surfaces covered with a graded abrasive. A first fabric strip is covered with a coarsely graded abrasive. A second fabric strip is covered with a finely graded abrasive. The improved method for buffing and polishing fingernails and toenails includes cleaning the nail, buffing the nail with a 1500 to 2400 grit abrasive for 15 to 30 seconds once during a first predetermined number of days, e.g. thirty days, further buffing the nail with a 2400 to 4500 grit abrasive for 15 to 30 seconds once during the first predetermined number of days, polishing the nail with a 4500 to 12000 grit abrasive for 15 to 30 seconds once during a second predetermined number of days, e.g. seven days, and further polishing the nail with a 12000 or greater grit abrasive for 15 to 30 seconds once during the second predetermined number of days.

9 Claims, 2 Drawing Sheets

SYSTEM AND METHOD FOR BUFFING AND POLISHING FINGERNAILS AND TOENAILS

TECHNICAL FIELD

This invention relates to an improved system and method for buffing and polishing fingernails and toenails.

BACKGROUND ART

There are a variety of rigid and flexible nail tools disclosed in the prior art. The abrasive surface of rigid nail tools, such as emery boards, contact only a small portion of a curved nail surface during any one stroke of the tool. As a result, rigid nail tools may not abrade the nail surface evenly or efficiently.

In contrast, the abrasive surface of flexible nail tools, such as those disclosed in U.S. Pat. No. 5,287,863 issued on Feb. 22, 1994 to La Joie et al., may be capable of contacting the entire surface of a nail during any one stroke. Although this flexible nail tool may abrade a nail surface evenly and more efficiently than rigid nail tools, nevertheless, it has several shortcomings. While U.S. Pat. No. 5,287,863 teaches a flexible file having a plurality of abrasive surfaces, it does not disclose the specific set of graded abrasives necessary to achieve optimal nail shine.

Accordingly, there is a need for an improved nail care system and method which provides a set of flexible nail tools covered with a predetermined set of graded abrasives and instructions to achieve a healthy of nails having an optimal shine. Further, the improved nail care system should be held in a package which is convenient to carry and which identifies and combines the set of tools in the proper order of use.

SUMMARY OF THE INVENTION

The present invention is an improved system and method for buffing and polishing fingernails and toenails. The improved nail care system includes at least two fabric strips. Each fabric strip has two surfaces with at least one of the two surfaces covered with a graded abrasive. A first fabric strip is covered with a coarsely graded abrasive. A second fabric strip is covered with a finely graded abrasive. The improved method for buffing and polishing fingernails and toenails includes cleaning the nail, buffing the nail with a 1500 to 2400 grit abrasive for 15 to 30 seconds once during a first predetermined number of days, e.g. 30 days, further buffing the nail with a 2400 to 4500 grit abrasive for 15 to 30 seconds once during the first predetermined number of days, polishing the nail with a 4500 to 12000 grit abrasive for 15 to 30 seconds once during a second predetermined number of days, e.g. 7 days, and further polishing the nail with a 12000 or greater grit abrasive for 15 to 30 seconds once during the second predetermined number of days.

Accordingly, an object of the present invention is to provide an improved nail care system including fabric strips covered respectively with different grades of abrasive and a method for using the same.

Another object of the present invention is to provide an improved nail care system in a package which is convenient to carry and combines the tools in a proper order for use in a method of nail care.

Yet another object of the present invention is to provide an improved nail care system including a convenient package having compartments for holding, identifying, and combining the abrasive covered fabric strips in a specific order of use.

A more specific object of the present invention is to provide an improved nail care system including at least two fabric strips. Each fabric strip has two surfaces with at least one of the two surfaces covered with a graded abrasive. A first fabric strip is covered with an abrasive graded in a range of 1500 to 2400 grit. A second fabric strip is covered with an abrasive graded in a range of 12000 or greater grit.

A more specific object of the present invention is to provide an improved method for buffing and polishing fingernails and toenails. The improved method includes cleaning the nail, buffing the nail with a 1500 to 2400 grit abrasive for 15 to 30 seconds once during a 30 day period, further buffing the nail with a 2400 to 4500 grit abrasive for 15 to 30 seconds once during the 30 day period, polishing the nail with a 4500 to 12000 grit abrasive for 15 to 30 seconds as needed but no more than once during a seven day period, and further polishing the nail with a 12000 or greater grit abrasive for 15 to 30 seconds as needed but no more than once during the seven day period. still more specific object of the present invention is to provide a nail care system which includes at least four fabric strips. Each fabric strip has two surfaces with at least one of the two surfaces covered with a graded abrasive. A first fabric strip is covered with an abrasive graded in a range of 1500 to 2400 grit. A second fabric strip is covered with an abrasive graded in a range of 12000 or greater grit. A third fabric strip and a fourth fabric strip are covered with an abrasive graded in a range of 2400 to 12000 grit.

A still more specific object of the present invention is to provide an improved nail care system which combines four fabric strips and a package. Each fabric strip has two surfaces with at least one of the two surfaces covered with a graded abrasive. A first fabric strip is covered with an abrasive graded in a range of 1500 to 2400 grit. A second fabric strip is covered with an abrasive graded in a range of 12000 or greater grit. A third fabric strip and a fourth fabric strip are covered with an abrasive graded in a range of 2400 to 12000 grit. The package includes holding compartments for each of the four fabric strips. The compartments identify and combines the four fabric strips in an order of use from coarsely graded abrasive to finely graded abrasive.

The above objects and other objects, features, and advantages of the present invention will be readily apparent from the following detailed description of the best mode for carrying out the present invention when taken in conjunction with the accompanying drawings.

BEST MODE FOR CARRYING OUT THE PRESENT INVENTION

Figure 1:
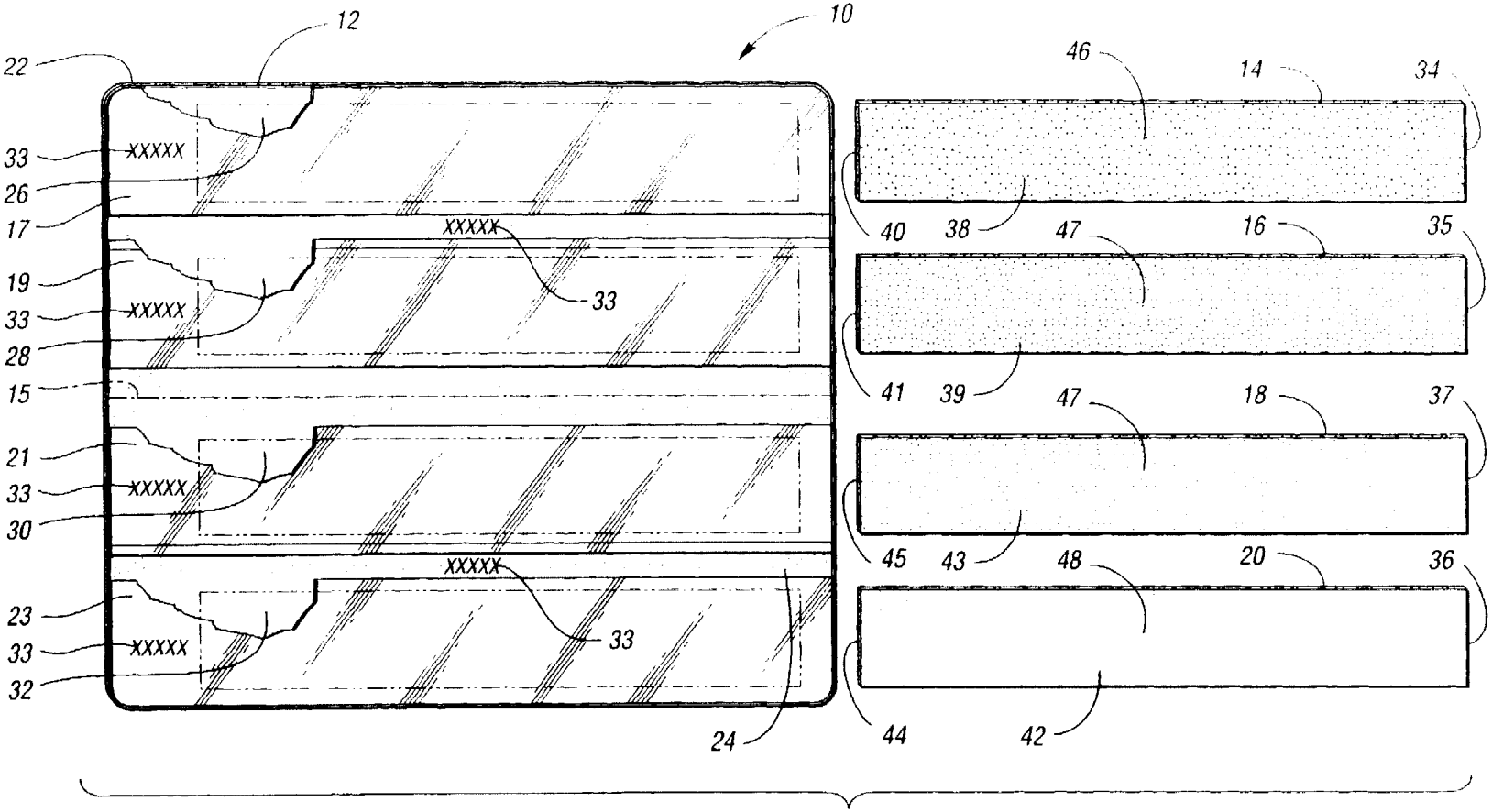
FIG. 1 is an unfolded perspective and cutaway view of a foldable nail care system package which compartmentalizes four abrasive fabric strips shown exploded from the package and in phantom within the package according to the present invention.

FIG. 1 shows a nail care system 10 in accordance with the present invention. Nail care system 10 is comprised of package 12, and four abrasive fabric strips 14, 16, 18, and 20. In a preferred embodiment, package 12 is made from a light weight material which may be folded in half along a fold line 15 thus providing a user with a package having a thin profile and which is convenient to carry. Package 12 has an outer surface 22 and an inner surface 24. Inner surface 24 includes four holding compartments 26, 28, 30, and 32 for storing each of the four abrasive strips 14, 16, 18, and 20 respectively. In a preferred embodiment, inner surface 24 is made of a white suede vinyl. Preferably, compartments 26, 28, 30, and 32 are made of a transparent material, such as ten gauge clear vinyl panels 17, 19, 21 and 23, so that a user may view each of the four strips 14, 16, 18, and 20 while in storage. Compartments 26, 28, 30, and 32 identify and combine the four fabric strips 14, 16, 18, and 20 in the specific order in which the system is to be used. The clear panels 17, 19, 21, and 23 may carry indicia at 33 to aid in the identification of the strip in each of the respective compartments. In a preferred embodiment, outer surface 22 is made of a durable, easy to clean plastic material, such as bordeaux patent vinyl.

FIG. 1 shows two of the abrasive fabric strips 14 and 20 in accordance with the present invention. Strips 14 and 20 are comprised of a flexible piece of fabric 34 and 36 respectively. Each piece of fabric 34 and 36 has two surfaces (upper and lower) 38, 40 and 42, 44 respectively. Each strip 14 and 20 has one surface (upper) 38 and 42 respectively covered with a graded abrasive. Surface 38 of strip 14 is covered with a coarsely graded abrasive 46 taken from a first range of abrasive grades. Surface 42 of strip 20 is covered with a finely graded abrasive 48 taken from a second range of abrasive grades.

Strips 16 and 18, as shown in FIG. 1, are also covered with a graded abrasive. Strips 16 and 18 are comprised of a flexible piece of fabric 35 and 37 respectively. Each piece of fabric 35 and 37 has two surfaces (upper and lower) 39, 41 and 43, 45 respectively. Each strip 16 and 18 has one surface (upper) 39 and 43 respectively covered with a graded abrasive. Strips 16 and 18 are covered with an intermediately graded abrasive 47 taken from a third range of abrasive grades between the first and second ranges of abrasive grades.

We have discovered that optimal nail shine is produced when the following specific ranges of abrasive grades are used in accordance with the method discussed below. The first range of abrasive grades includes coarsely graded in a range of 1500 to 2400 grit. The second range of abrasive grades includes abrasive finely graded in a range of 12000 or greater grit. The third range of abrasive grades includes abrasive intermediately graded in a range of 2400 to 12000 grit. In a preferred embodiment, the strip 14 is covered with a 1800 grit abrasive, strip 16 is covered with a 3600 grit abrasive, strip 18 is covered with a 6000 grit abrasive, and strip 20 is covered with a 12000 grit abrasive.

Figure 2:
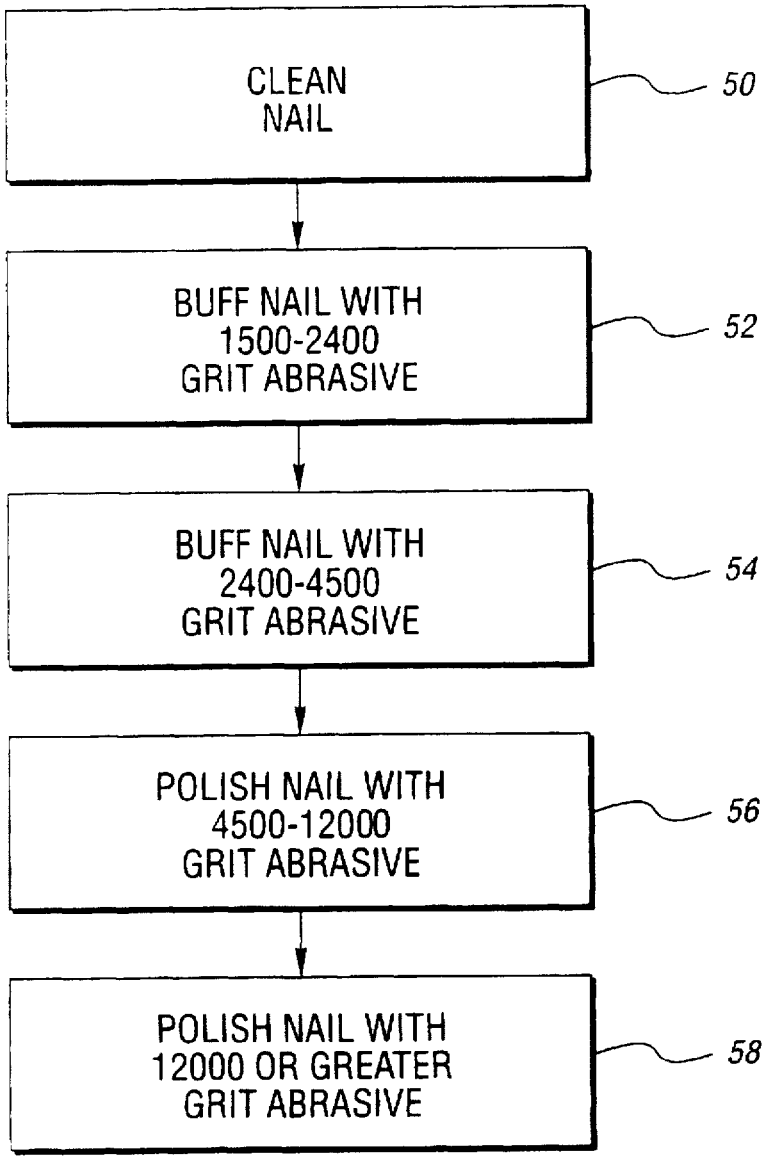
FIG. 2 is a flow chart illustrating a method for utilizing the nail care system according to the present invention.

FIG. 2 shows a flow chart illustrating a method for utilizing nail care system 10 according to the present invention. First, the nail is cleaned as illustrated by block 50. The nail should be cleaned with soap and water and then dried. The cleaned nail should be free of any nail polish, dirt, etc. Second, the nail is buffed with strip 14 preferably having a 1800 grit abrasive within the range of a 1500 to 2400 grit abrasive for 15 to 30 seconds once during a first predetermined number of days, preferably thirty days, as illustrated by block 52. Third, the nail is buffed with strip 16 preferably having a 3600 grit abrasive within the range of a 2400 to 4500 grit abrasive for 15 to 30 seconds once during the first predetermined number of days, preferably thirty days, as illustrated by block 54. Fourth, the nail is polished with strip 18 preferably having a 6000 grit abrasive within the range of a 4500 to 12000 grit abrasive for 15 to 30 seconds once during a second predetermined number of days, preferably seven days, as illustrated by block 56. Finally, the nail is polished with strip 20 preferably having a 12000 grit abrasive with the range of a 12000 or greater grit abrasive for 15 to 30 seconds once during the second predetermined number of days, preferably seven days, as illustrated by block 58.

In a preferred embodiment, each of the four fabric strips 14, 16, 18, and 20 are comprised of an exposed surface having a different color. One brand of abrasive fabric strip particularly useful in this invention is manufactured by Micro-Surface Finishing Products Inc. in Wilton, Iowa. Further each holding compartment 26, 28, 30, and 32 is labeled with the respective color of the strip it is to hold. In this manner, the four fabric strips 14, 16, 18, and 20 are identified and combined in the order in which they are to be used. Finally, on the inner surface 22 of package 12 strips 14 and 16 are labeled at 33 as buffers and strips 18 and 20 are labeled at 33 as polishers.

It is to be understood, of course, that while the forms of the present invention described above constitute the best mode contemplated of practicing the present invention, the preceding description is not intended to illustrate all possible forms thereof. It is also to be understood that the words used are words of description, rather than of limitation, and that various changes may be made without departing from the spirit and scope of the present invention, which should be construed according to the following claims.

We claim:

1. A nail care system for buffing and polishing fingernails and toenails, the system comprising:

at least two fabric strips;

each of said at least two fabric strips having a surface covered with a graded abrasive;

one of said covered surfaces of said at least two fabric strips covered with a coarsely graded abrasive falling within the range of 1500 to 2400 grit; and another of said covered surfaces of said at least two fabric strips covered with a finely graded abrasive having at least a 12000 grit.

2. The nail care system of claim 1 further including a third fabric strip having a surface covered with an intermediately graded abrasive falling within the range of 2400 to 12000 grit.

3. The nail care system of claim 1 further including a fourth fabric strip having a surface covered with an intermediately graded abrasive falling within the range of 2400 to 12000 grit.

4. The nail care system of claim 1 further including a package having a holding compartment for each of said at least two fabric strips, said compartments identifying and combining each of said at least two fabric strips in an order of use from coarsely graded abrasive to finely graded abrasive.

5. A nail care device for buffing and polishing fingernails and toenails, the device comprising:

a fabric strip having a surface covered with a graded abrasive, wherein the fabric strip has sufficient flexibility to conform to the size and shape of a nail to abrade the nail surface evenly for buffing and polishing.

6. The nail care device of claim 5 wherein the fabric strip has a generally rectangular shape.

7. A method of buffing and polishing a fingernail and toenail, the method comprising:

cleaning said nail;

buffing said nail with a 1500 to 2400 grit abrasive for 15 to 30 seconds once during a first predetermined number of days;

buffing said nail with a 2400 to 4500 grit abrasive for 15 to 30 seconds once during said first predetermined number of days;

polishing said nail with a 4500 to 12000 grit abrasive for 15 to 30 seconds once during a second predetermined number of days; and polishing said nail with a 12000 or greater grit abrasive for 15 to 30 seconds once during said second predetermined number of days.

8. The method of claim 7 wherein said first predetermined number of days is thirty days.

9. The method of claim 7 wherein said second predetermined number of days is seven days.

* * * * *